US005324587A

United States Patent [19]

Nitowski et al.

[11] Patent Number: 5,324,587

[45] Date of Patent: Jun. 28, 1994

[54] ADHESIVELY BONDED ALUMINUM

[75] Inventors: Gary A. Nitowski, Natrona; Karl Wefers; Larry F. Wieserman, both of Apollo, all of Pa.

[73] Assignee: Aluminum Company of America, Pittsburgh, Pa.

[21] Appl. No.: 787,281

[22] Filed: Nov. 4, 1991

Related U.S. Application Data

[62] Division of Ser. No. 456,519, Dec. 26, 1989, Pat. No. 5,131,987.

[51] Int. Cl.[5] ..... C25D 11/18

[52] U.S. Cl. ..... 428/469; 428/416; 205/58; 148/253; 148/255; 148/256; 204/90

[58] Field of Search ..... 428/116, 224, 416, 469; 205/58; 148/253, 255, 256; 204/90

[56] References Cited

U.S. PATENT DOCUMENTS 4,025,681 5/1977 Donnelly et al. ..... 428/116
4,085,012 4/1978 Marceau et al. ..... 204/38
4,127,451 11/1978 Marceau et al. ..... 204/38
4,604,341 8/1986 Mohr ..... 430/278

FOREIGN PATENT DOCUMENTS 83006639 3/1978 Japan .

*Primary Examiner*—Marion E. McCamish
*Assistant Examiner*—Richard C. Weisberger
*Attorney, Agent, or Firm*—Andrew Alexander; Glenn E. Klepac

[57] ABSTRACT

A laminate suitable for vehicular applications includes at least two sheets of aluminum alloy and an adhesive layer between the sheets bonding them together. An oxide layer on surfaces of the sheets is treated with a phosphorous acid electrolyte, so that a coordination number of four predominates for the aluminum-oxygen-phosphorous bond. Equivalent bonding strengths in the laminates are obtained in substantially less time with phosphorous acid treatment compared with phosphoric acid treatment.

13 Claims, 6 Drawing Sheets

ADHESIVELY BONDED ALUMINUM

This application is a division of application Ser. No. 07/456,519, filed Dec. 26, 1989, now U.S. Pat. No. 5,131,987.

INTRODUCTION

This introduction relates to anodized aluminum articles and more particularly to anodizing aluminum to provide a surface for adhesive bonding.

In U.S. Pat. Nos. 4,127,451 and 4,085,012, there is disclosed a method of preparing an adhesive bond wherein an aluminum article is anodized in phosphoric acid and then bonded to join aluminum articles together. Anodizing time can be as high as 30 minutes. U.S. Pat. No. 4,127,451 discloses a method for forming a honeycomb structure using aluminum foil which is anodized in phosphoric acid, then primed, cured before an adhesive is applied, cured and formed into a honeycomb structure.

Japanese Patent Publication 83006639 discloses a production method for a printing plate in which an aluminum alloy is anodized using an electrolyte containing phosphorous acid.

SUMMARY OF THE INVENTION

It is an object of the present invention to provide a new process for adhesively bonding aluminum members.

It is another object of the present invention to provide a new anodizing process as a pretreatment for adhesively joining aluminum components.

Yet it is another object of the present invention to provide a new surface treatment on aluminum for adhesive bonding purposes.

A further object of the present invention is to provide an adhesively bonded aluminum structure or article employing a new finish or anodic coating on the aluminum structure.

These and other objects will be apparent from the specification, drawings and claims appended hereto.

In accordance with these objects, there is provided an article and a process for making an article comprised of adhesively bonded aluminum, the process comprising the steps of anodizing an aluminum alloy member surface in a phosphorous acid ($H_3PO_3$) electrolyte to form an anodic coating on said surface, the coating suitable for providing a high strength environmentally stable adhesive bond and capable of being formed in the electrolyte in two minutes or less. An adhesive is applied to the anodized surface for bonding to another surface to form the article.

DETAILED DESCRIPTION OF THE PREFERRED EMBODIMENTS

Figure 1A:
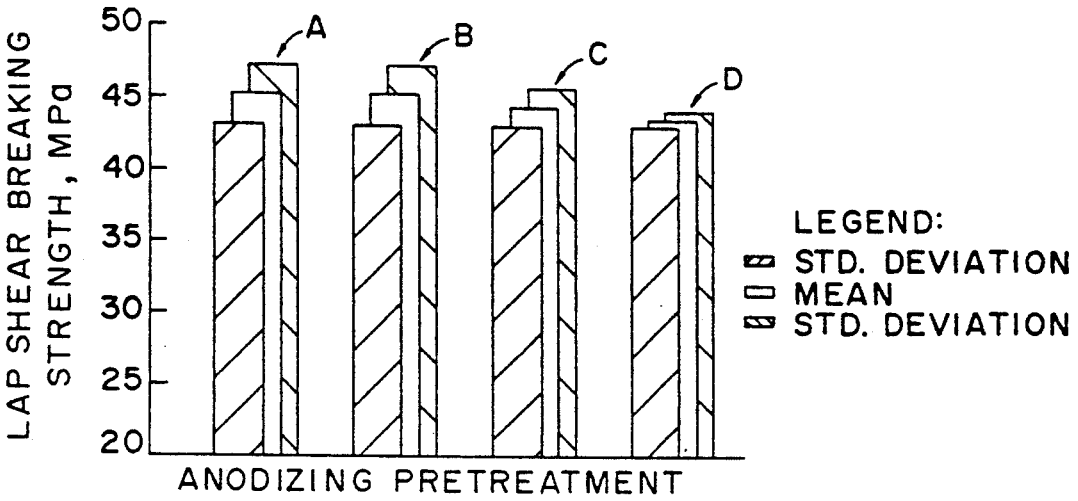
FIGS. 1*a* and 1*b* show graphs comparing phosphorous acid anodizing to other treatments to 7075-T6 aluminum alloy for adhesive bonding.

In accordance with the present invention, aluminum articles to be prepared for bonding may be first vapor degreased and then subjected to an alkaline or acid cleaner. This may be followed by a deoxidizing treatment with appropriate rinsing in between the steps.

The aluminum article is then subjected to an anodizing treatment in an electrolyte containing phosphorous acid ($H_3PO_3$). The electrolyte preferably is comprised of water and phosphorous acid ($H_3PO_3$). The electrolyte can contain from 1 to 30 wt. % $H_3PO_3$ acid, preferably 5 to 15 wt. % $H_3PO_3$ acid. During anodizing, the electrolyte should be kept at a temperature in the range of 3° to 60° C. Anodization can be carried out in a time period of about 0.1 to 60 minutes. Preferred time periods for anodization range from about 0.75 to 5 minutes with typical times being about 1 to 3 minutes.

The anodization can be carried out at a current density of 0.5 to 50 mA/cm$^2$ and preferably 1 to 10 mA/cm$^2$. While direct current is preferred, alternating or pulsed current or combinations of AC/DC may be used. The voltage for anodizing should be maintained in the range of 2 to 100V and preferably 5 to 40V. Further, a continuous method or a batch method may be used in anodizing. One of the advantages of the present system resides in the very short anodizing times required to produce an anodic coating which has equal or superior bonding properties when compared to conventional anodizing approaches in phosphoric acid ($H_3PO_4$) or chromic acid. After anodizing, the anodized surface may be rinsed free of electrolyte.

The anodic film produced in accordance with the present invention can have a thickness in the range of 10 nm to 10 μm and a density in the range of 2.5 to 3.2 gms/cc. Although the cell and pore geometry of coatings formed anodically in phosphorous acid at 23° C. is comparable to that of coatings formed in phosphoric acid (FIG. 7), there are significant differences in the atomic arrangement or coordination. Nuclear Magnetic Resonance (NMR) measurements show that the coordination number of aluminum bonded to phosphorus through oxygen (Al-O-P) in the oxide layer is four and six in phosphoric acid formed coatings, while a coordination number of four predominates for Al-O-P in phosphorous acid formed films. The Al-O-Al coordination is predominantly octahedral (sixfold) in both phosphoric and phosphorous acid formed anodic oxides, with about 20% tetrahedral coordination of Al-O-Al in phosphorous acid coatings is only 10% in phosphoric acid coatings. The coordination number of an atom or ion in a lattice is the number of near neighbors to that atom or ion.

In the instant invention, the anodized article may be primed or the adhesive may be applied directly to the anodized finish. A primer is selected according to the adhesive used in the bonding process. A suitable epoxy primer is available from American Cyanamide Corporation under the designation BR127 and requires a 250° F. cure.

An adhesive such as an epoxy, acrylic, phenolic, polysulfone or polyimide resin can be applied either to the cured primer or to the anodized articles. A suitable epoxy adhesive is available, e.g., from 3M Corporation under the designation AF163. After application of the adhesive to aluminum articles, they are arranged in a composite arrangement and the joint held firmly and cured or permitted to set at the designated temperature to provide for the proper bond between the articles. By setting or set as used herein is meant the bonding of the adhesive to anodized coating where a thermosetting or thermoplastic adhesive or mixtures thereof are used. Cure as used herein can include cooling of thermoplastic to permit it to harden and bonding thereof.

Alloys which may be joined or bonded together in this manner include AA1000, AA2000, AA5000, AA6000 or AA7000 series alloys, e.g., AA2024, AA6061 or AA7075, although most aluminum alloys, including clad alloys which can be anodized in phosphorous acid ($H_3PO_3$), can be used. Further, other metallic, polymeric or ceramic materials may be joined to the aluminum article with an appropriate adhesive.

Joints formed in this manner have been found to have a high level of stability in high temperature humidity tests according to ASTM 3762-79 (wedge test), as shown in FIGS. 1–6. The crack extension for joints formed in phosphorous acid is consistently as low as or lower than for joints formed from aluminum treated with more time consuming treatments in other electrolytes. Minimal crack growth in the wedge test is an indication of good environmental stability.

In another aspect of the invention, aluminum sheet processed or anodized in accordance with the invention can be used in laminates of sheet metal and polymer or adhesive with or without fiber reinforcement. That is, two, three, four or more sheets of aluminum may be bonded together with an adhesive. The adhesive may or may not have reinforcing fibers embedded or dispersed therein. The aluminum sheet is treated and anodized as disclosed herein. After rinsing and drying, an adhesive or a prepreg consisting of a film adhesive containing reinforcing fibers may be applied to one side of the sheet and the second anodized sheet placed on top thereof. Several layers may be set up in this way as desired. Thereafter, layers are pressed together firmly and cured to form a bonded laminate having outstanding fatigue properties and hydrothermal stability.

While reference has been made herein to individual layers of adhesive and reinforcing media, it will be appreciated that the fibers may be discontinuous and dispersed in the adhesive or the reinforcing fabric may be impregnated with adhesive. Further, the adhesive may be of the thermoplastic or thermoserring type. Further, a laminate may be formed having a single metal sheet having both sides coated with a polymer with or without fibers.

Any alloy product may be pretreated and adhesively bonded in this manner. However, the alloy may be selected depending on the application. For aircraft use, AA7000 series or AA2000 series may be used. For example, AA7075, AA7475, AA2024 or AA2090 may be used to provide high strength structural joints and laminates. The alloy may be provided in plate, sheet, castings or extrusions, for example. The use of sheet herein is intended to include foils (thickness from 5 to 250 μm, for example) and a laminate which may include a single metal sheet with a polymer layer on each side.

Fibers which may be used in the laminate, include glass, carbon, graphite, boron, steel, titanium carbide and the like. Fibers such as homo- or copolymers of aramids are particularly suitable, more particularly, poly-paraphenylene terephthalamide, or of aromatic polyamide hydrazides or fully aromatic polyesters are suitable. The amount of fiber in the adhesive layer can range from 1 to 80, preferably 40 to 60, wt. %, based on the weight of both components. It is preferred that the adhesive/fiber layer in the laminate be thinner than the metal sheet thickness.

The adhesive may be of thermoplastic or thermosetting type as noted herein. Adhesives that are suitable for use in the laminates include, e.g., AF163 epoxy adhesive and XA-3498 epoxy adhesive available from 3M.

For making a pre-stressed product, the laminate is stretched an amount greater than the specific elastic elongation of the aluminum sheet and less than the specific break elongation of the fibers and the aluminum sheets. Typically, a 0.01 to 5% stretch is suitable. The fibers may be stretched prior to curing the adhesive such that after curing the aluminum sheet is in compression stress and the fibers remain in tensile stress. Fibers which respond to the stretching condition include aramids. Pre-stressing is disclosed in U.S. Pat. No. 4,489,123, incorporated herein by reference.

Laminates in accordance with the invention are suitable for use in aircraft application such as wing panels or where there is required high fatigue properties. Further, adhesively bonded articles in accordance with the invention are suitable for applications such as vehicular uses where high strength bonding is necessary. By vehicular is meant to include all automotive applications, including body panels and frame components, and refers also to automobiles, bicycles, motorcycles, trucks, off-road vehicles, transport vehicles, as well as boats, ships, aircraft and spacecraft applications, such as rockets, missiles and the like.

EXAMPLE 1

Figure 1B:
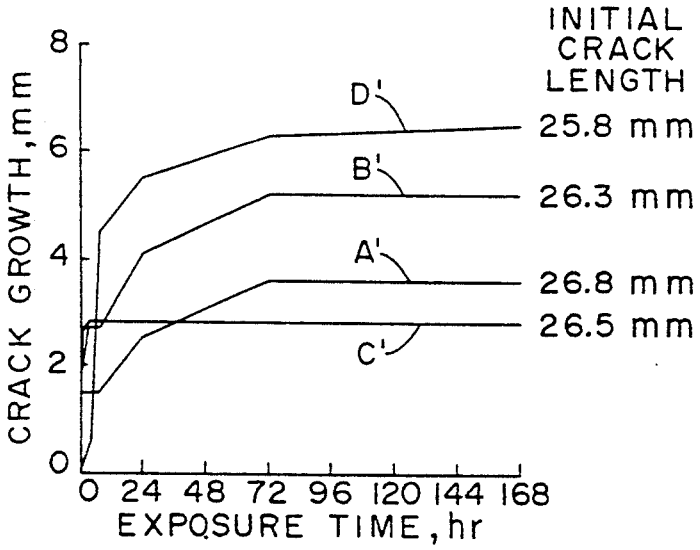

Adhesive bonding data comparing different surface preparation techniques are shown in FIGS. 1*a* and 1*b*. All samples were prepared for anodizing as follows: Unclad AA7075-T6 was machined to appropriate dimensions for the lap shear test (ASTM D-1002) and for the wedge test (ASTM D-3762-79). The surfaces were vapor degreased by exposure to the vapors of trichloroethylene for 5 minutes at 87° C. Upon cooling, the surfaces were then etched in a non-chromate acidic bath for 1.5 minutes at 23° C. After acid etching, the aluminum surfaces were rinsed with flowing tap water for 30 seconds to remove residual etchant, dried at 50° C., divided into four groups and anodized as follows: One quarter of the samples were anodized at 10v in 10% (w/w) phosphoric acid solution for 20 minutes at 23° C.

(A, FIG. 1*a*, A', FIG. 1*b*). One quarter of the samples were anodized at 6.5 mA/cm$^2$ in 10% (w/w/) phosphoric acid solution for 2 minutes at 23° C. (B, FIG. 1*a*, B', FIG. 1*b*). One quarter of the samples were anodized at 20V in 10% (w/w) phosphorous acid ($H_3PO_3$) solution for 2 minutes at 23° C. (C, FIG. 1*a*, C', FIG. 1*b*). One quarter of the samples were anodized in 0.5M chromic acid solution at 38° C. using a step voltage schedule which consists of anodizing at 4V for 2 minutes then increasing the voltage 4V/min to 40V, holding at 40v for 20 minutes, increasing to 42V for 2 minutes, then increasing 2V/min to 50V, and holding at 50V for 5 minutes (D, FIG. 1*a*, D', FIG. 1*b*).

All anodized samples were rinsed for 30 seconds in flowing deionized water and dried at 50° C. The samples were then assembled, within 24 hours of anodization, using AF163 epoxy resin film adhesive manufactured by Minnesota Mining and Manufacturing Company. This adhesive is typically used for aerospace applications. The adhesive bondline thickness of the lap shear specimens was controlled at 0.51 nun using a lap shear bonding fixture. The lap shear assemblies were cured in the lap shear fixture at 121° C. for 1 hour. Breaking strength was determined on an Instron Model 1127 equipped with a 222.4 KN load cell, using a cross-head speed of 1.27 cm/min.

The adhesive bondline thickness of the wedge test assemblies was controlled at 0.38 mm using stainless steel shims. The assemblies were cured in a platen press for 1 hour at 121° C. with 310.3 KPa pressure and then cut into 2.54 cm wide specimens. Thereafter, the specimens were cracked according to ASTM D-3762-79, the initial crack length was marked, and the specimens then were placed in condensing humidity at 52° C. Crack progression in the humidity chamber was checked periodically.

The lap shear data of FIG. 1*a* show that the 2 minute anodization in phosphorous acid results in bonded joints with strengths equivalent to joints assembled from samples anodized by a 20 minute phosphoric acid process or a 40 minute chromic acid process.

Furthermore, the wedge test data of FIG. 1*b* show that the joints assembled from substrates which were anodized for 2 minutes in phosphorous acid ($H_3PO_3$) exhibited the smallest crack extension (<3 mm) of all the assemblies studied. Minimal crack extension is an indication of good joint hydrothermal stability. Joints formed from the 20 minute phosphoric acid anodization had the next best hydrothermal performance whereas the 2 minute phosphoric acid anodization and the 40 minute chromic acid anodization provided joints with inferior hydrothermal durability.

EXAMPLE 2

The example is similar to Example 1 except that unclad 2024-T3 was used. Furthermore, the acid etch used prior to anodization consisted of 50 g/L chromic trioxide and 250 g/L of 95% (w/w) sulfuric acid. The samples were etched at 63° C. for 14 minutes. Furthermore, phosphorous acid ($H_3PO_3$) anodization of 2024-T3 alloy was done at 10V, as opposed to 20V, used for 7075-T6.

Figure 2A:
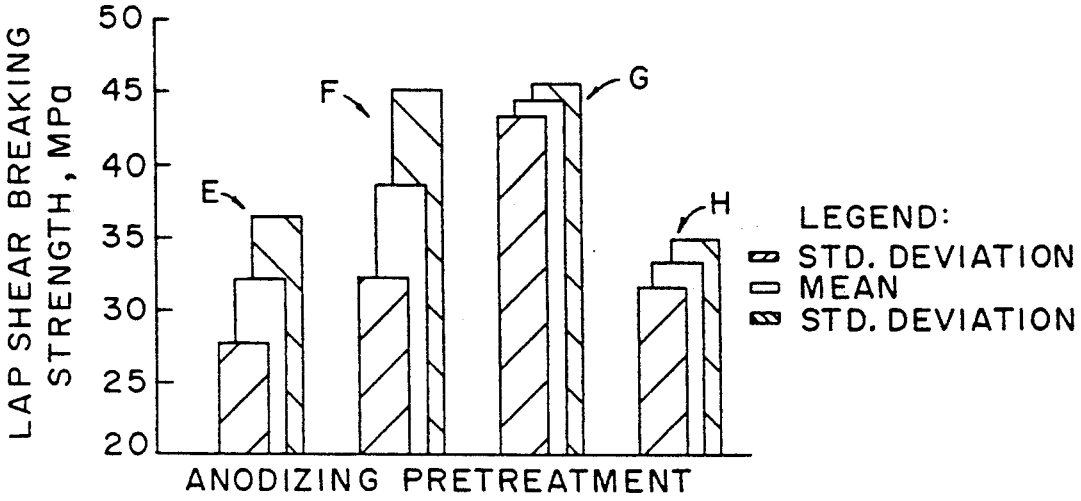
FIGS. 2*a* and 2*b* show graphs comparing phosphorous acid anodizing to other treatments to 2024-T3 aluminum alloy for adhesive bonding.

The lap shear data of FIG. 2*a* show that joints formed from substrates anodized for 2 minutes in phosphorous acid ($H_3PO_3$) solution (G) had significantly superior strength compared with the 20 minute phosphoric acid (E) anodization and the 40 minute chromic acid anodization (H). While the strength of the joints formed from substrates anodized for 2 minutes in phosphoric acid (F) approached that of the phosphorous acid anodized joints, the variability in strength for the 2 minute phosphoric acid anodized joints was unacceptable.

Figure 2B:
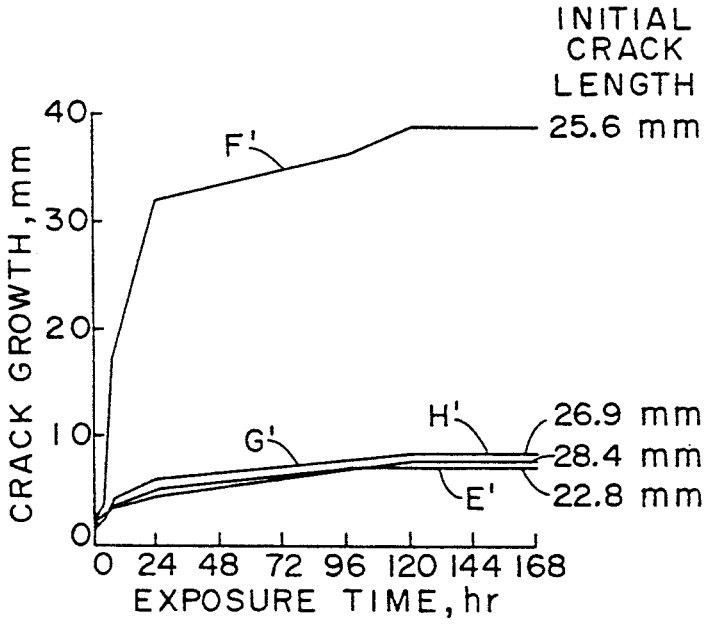

The wedge test data of FIG. 2*b* show that there is no significant difference in crack extension, and therefore, hydrothermal durability for joints formed from substrates anodized for 2 minutes in phosphorous acid (H'), 20 minutes in phosphoric acid (E'), or 40 minutes in chromic acid (G'). Anodizing unclad 2024-T3 for 2 minutes in phosphoric acid (F') yields joints with significantly inferior hydrothermal durability.

EXAMPLE 3

This examples is similar to Example 2 except that after anodizing and drying, and prior to bonding, the samples were primed with a 5 μm thick coating of BR127, an epoxy-modified phenolic primer manufactured by American Cyanamide.

Figure 3A:
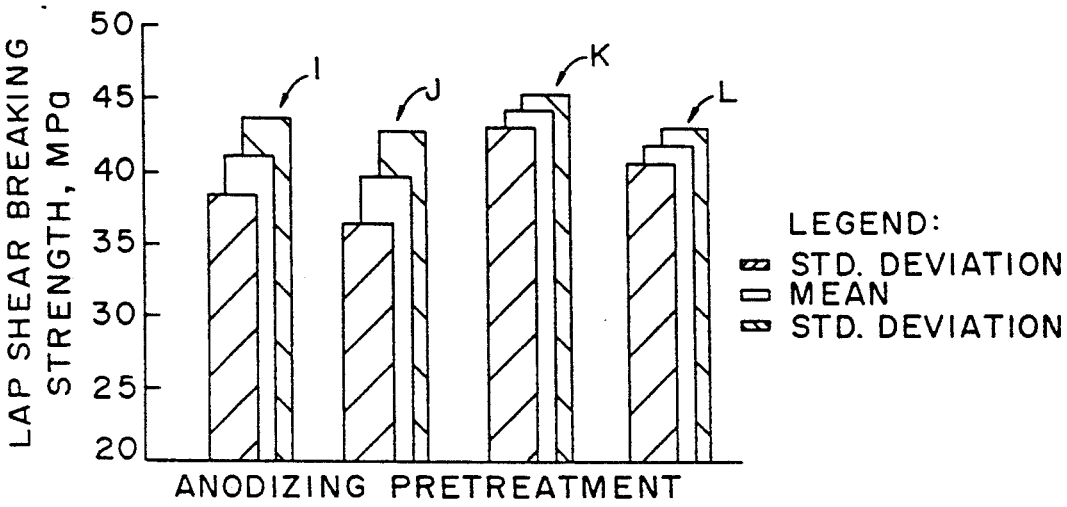
FIGS. 3*a* and 3*b* show graphs comparing phosphorous acid anodizing, with subsequent priming, to other treatments to 2024-T3 aluminum alloy for adhesive bonding.
Figure 3B:
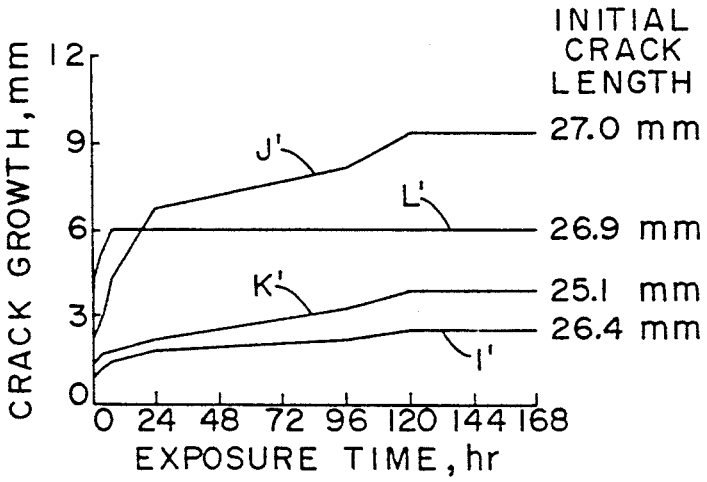

The lap shear data of FIG. 3*a* show that the 2 minute phosphorous acid anodization (K) yielded joints with the highest lap shear breaking strength (44 MPa). The joints formed for substrates anodized in the other acids (I=20 min. $H_3PO_4$, J=2 min. $H_3PO_4$ and L=40 min. $Cr0_3$) had slightly lower strengths (40–42 MPa). It was noted that priming had a significant positive effect on the lap shear breaking strength of joints formed from substrates treated in phosphoric and chromic acid. The effect was to raise the strengths closer then the strength of joints with phosphorous acid anodized substrates. Priming had no effect on the strength of joints formed with phosphorous acid anodized substrates.

The wedge test data for joints formed from anodized and primed substrates (FIG. 3*b*) show that there is a slight improvement in joint hydrothermal durability as a result of priming, and that there is no significant difference in the performance of joints anodized for 2 minutes in phosphorous acid (K') or 20 minutes in phosphoric acid (I'). The 40 minute chromic acid (C') anodizing and the 2 minute phosphoric acid (J') anodizing were shown to be inferior with respect to enhancing joint hydrothermal stability.

EXAMPLE 4

In this example, all substrates were anodized in phosphorous acid solution, and the time of anodization was either 0.5 (P'), 1 (M or M'), 2 (N or N') 5 (O or O') or 10 minutes.

Figure 4A:
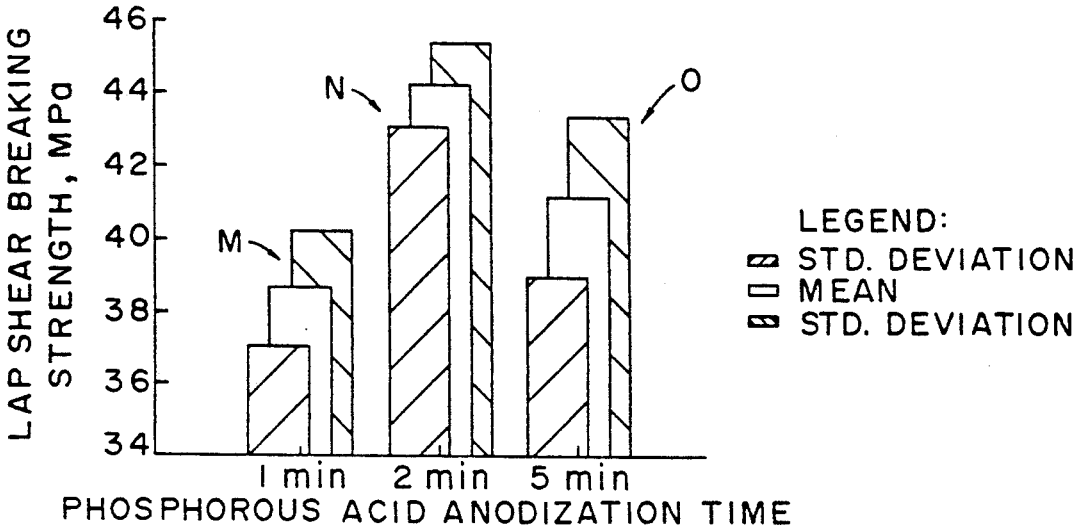
FIGS. 4*a* and 4*b* show the effect of anodizing time in phosphorous acid on the strength and stability of adhesive joints.

The lap shear data of FIG. 4*a* show that optimum joint strength is achieved at a 2 minute anodization in phosphorous acid.

Figure 4B:
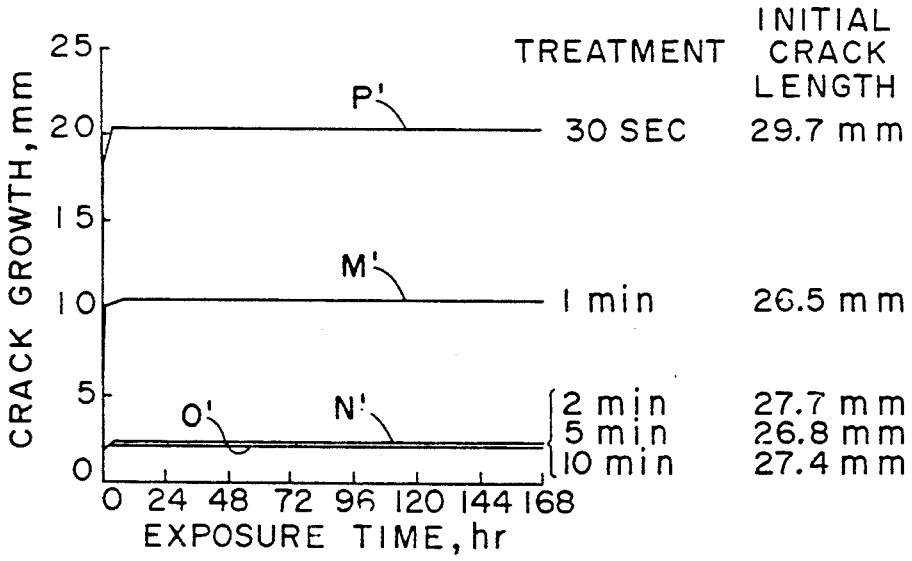

The wedge test data of FIG. 4*b* show that a 2 minute anodization in phosphorous acid (N') is an optimal time of anodization for providing good hydrothermal durability to an adhesive joint.

EXAMPLE 5

In this example, specimens were prepared as follows: Unclad aluminum alloy 6061-T6 was machined to appropriate dimensions for the wedge test (ASTM D-3762-79). The surfaces were vapor degreased by exposure to the vapors of trichloroethylene for 5 minutes at 87° C. Upon cooling, the surfaces were then etched in an acidic bath for 1.5 minutes at 23° C. After acid etching, the aluminum surfaces were rinsed with flowing tap water for 30 seconds to remove residual etchant, dried at 50° C. and divided into two groups and then anodized as follows: One half of the samples were anodized at 20V in 10% (w/w) phosphoric acid (R and T) solution for 2 minutes at 23° C. One half of the samples were anodized at 20V in 10% (w/w) phosphorous acid ($H_3PO_3$) solutions (S and U) for 2 minutes at 23° C. All anodized samples were rinsed for 30 seconds in flowing deionized water and dried at 50° C. One half of each acid anodized samples were then assembled, within 24 hours of anodization, using AF163 epoxy resin film adhesive manufactured by Minnesota Mining and Manufacturing Company. Curing conditions were the same as for Example 1. The other half of each acid anodized samples were assembled using an epoxy paste adhesive, XA-3498, an experimental adhesive manufactured by Minnesota Mining and Manufacturing Company. This adhesive is intended for automotive applications. Bondline thickness was controlled as in Example 1. The XA-3498 wedge test assemblies were cured in a platen press at 149° C. for 30 minutes with 22.24 KN applied force.

Figure 5:
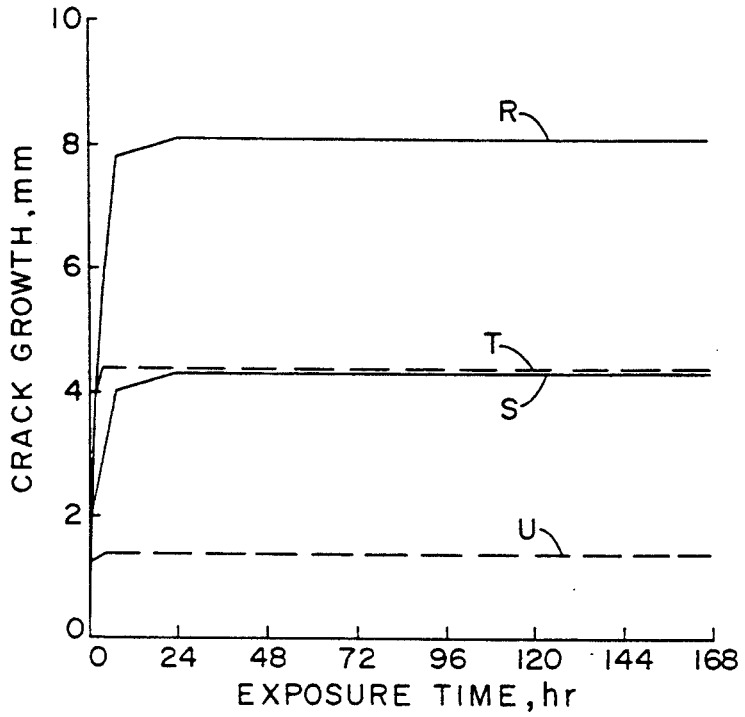
FIG. 5 shows a graph comparing the stability of phosphorous acid formed using adhesive bonds and phosphoric acid anodized substrates, which substrates were anodized under potentiostatic conditions with all treatment variables equivalent.

FIG. 5 shows wedge test data for joints assembled from substrates receiving a 2 minute, 20V phosphoric acid anodization, and from substrates receiving a 2 minutes, 20V phosphorous acid anodization. The joints formed from substrates receiving the phosphorous acid anodization exhibited superior hydrothermal durability as compared with joints formed from substrates receiving the phosphoric acid anodization. The better performance of the phosphorous acid anodized joints was observed for both the aerospace epoxy film adhesive, and the automotive epoxy paste adhesive.

EXAMPLE 6

In this example, specimens were prepared as follows: Unclad aluminum alloy 2024-T3 was machined to appropriate dimensions for the wedge test (ASTM D-3762-79). The surfaces were vapor degreased by exposure to the vapors of trichloroethylene for 5 minutes at 87° C. Upon cooling, the surfaces were then etched in a solution consisting of 50 g/L chromic trioxide and 250 g/L of 95% (w/w) sulfuric acid at 63° .C for 14 minutes. After acid etching, the aluminum surfaces were rinsed with flowing tap water for 30 seconds to remove residual etchant, dried at 50° C., then divided into two groups and anodized as follows: One half of the samples were anodized at a current density of 7 mA/cm$^2$ in phosphoric acid solution having a conductivity of 103.6 mS for 5 minutes at 23° C. The remaining samples were anodized at a current density of 7 mA/cm$^2$ in phosphorous acid solution having a conductivity of 103.6 mS for 5 minutes at 23° C. All anodized samples were rinsed for 30 seconds in flowing deionized water and dried at 50° C.

The samples were then assembled, within 24 hours of anodization, using AF163 epoxy resin film adhesive. The adhesive bondline thickness of the wedge test assemblies was controlled at 0.35 mm using stainless steel shims. The assemblies were cured in a platen press for 1 hour at 121° C, with 310.3 KPa pressure and then cut into 2.54 cm wide specimens. The specimens were cracked according to ASTM D-3762-79, the initial crack length was marked, and the specimens were placed in condensing humidity at 52° C. Crack progression in the humidity chamber was checked periodically.

Figure 6:
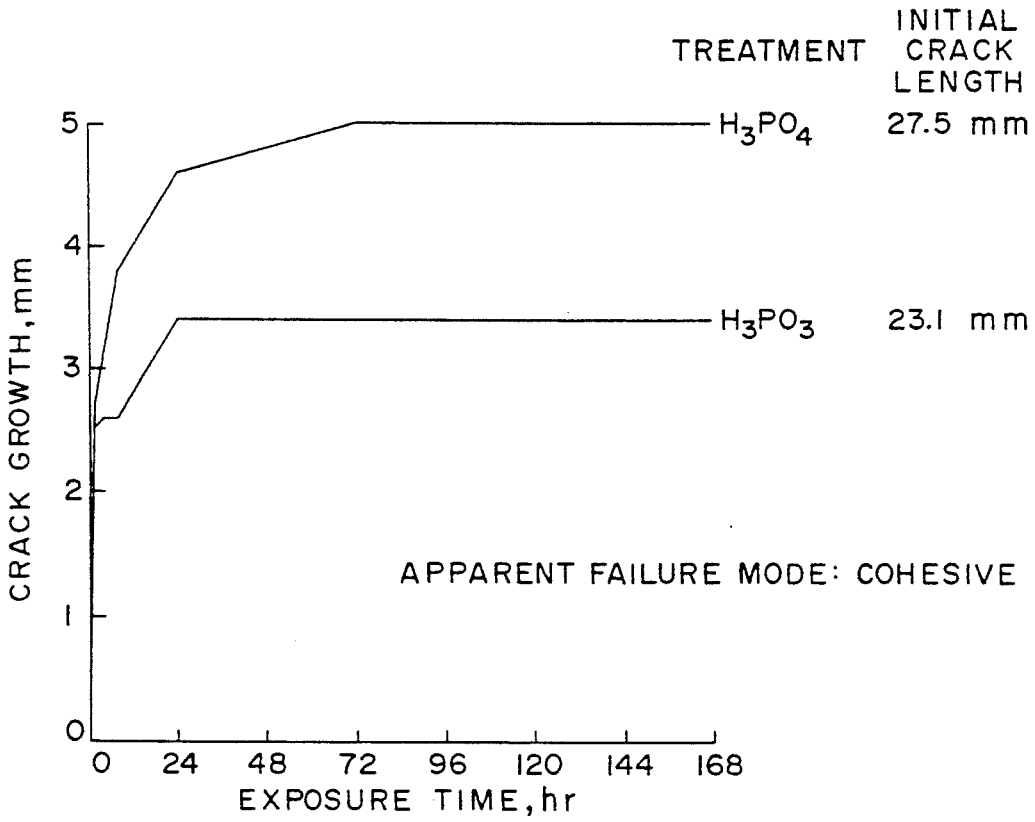
FIG. 6 shows a graph comparing the stability of adhesive bonds formed using phosphorous acid anodized and phosphoric acid anodized surfaces, which surfaces were anodized under galvanostatic conditions in solutions with the same conductivities and all treatment variables equivalent.

The wedge test data of FIG. 6 show that under equivalent conditions, joints formed from substrates anodized in the phosphorous acid solution had smaller crack extensions than those anodized in the phosphoric acid solutions, and thus have a higher degree of hydrothermal stability. Since phosphorous acid has a greater $pKa_1$ value than phosphoric acid, the ionic concentration of the solutions were made equivalent by preparing solutions of equivalent conductivities. By anodizing under galvanostatic conditions in solutions with equivalent conductivities, oxides of similar thicknesses and structures are formed.

EXAMPLE 7

In this example, specimens were prepared as follows: Unclad aluminum alloy 6061-T6 was machined to appropriate dimensions for the wedge test (ASTM D-3762-79). The surfaces were vapor degreased by exposure to the vapors of trichloroethylene for 5 minutes at 87° C. Upon cooling, the surfaces were then etched in an acidic bath for 1.5 minutes at 23° C. After acid etching, the aluminum surfaces were rinsed with flowing tap water for 30 seconds to remove residual etchant, dried at 50° C., and anodized as follows: One sample was anodized at 20V in 10% (w/w) phosphorous acid solution for 2 minutes at 23° C. One sample was anodized at 6.5 mA/cm$^2$ in 10% (w/w) phosphoric acid solution for 2 minutes at 23° C. One sample was anodized at 10V in 10% (w/w) phosphoric acid solution for 20 minutes at 23° C. All samples were rinsed for 30 seconds in flowing deionized water and dried at 50° C. and then the surface was scribed into 2 mm×2 mm squares. The samples were immersed in a saturated mercuric chloride solution in order to remove the oxide films which were subsequently rinsed three times in fresh distilled water. The oxide films were put onto transmission electron microscope grids and examined with transmission electron microscopy.

Figure 7A:
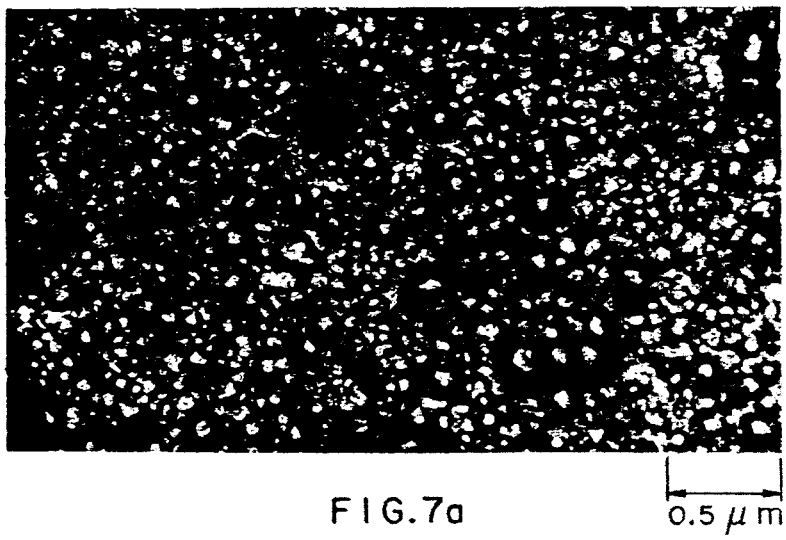
FIG. 7*a* shows transmission electron micrographs of an anodic oxide film formed in phosphoric acid in 2 minutes.
Figure 7B:
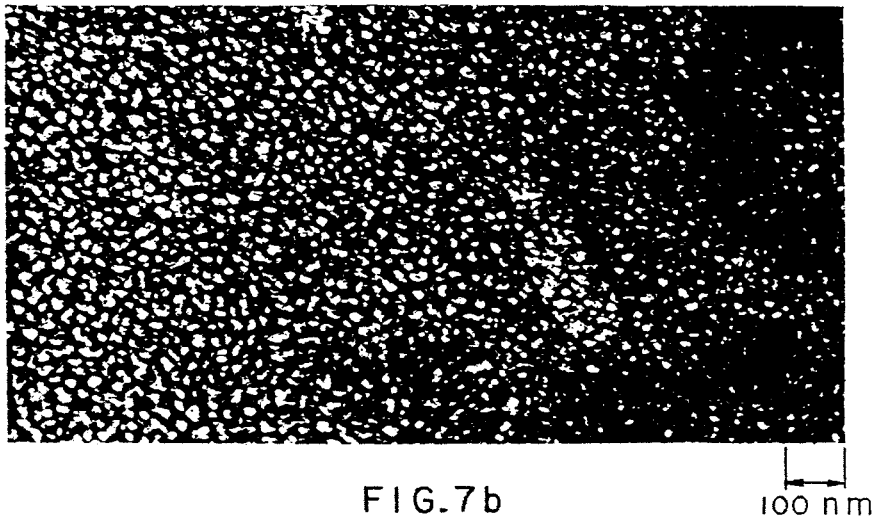
FIG. 7*b* is a transmission electron micrograph of an anodic oxide film formed with phosphoric acid in 20 minutes.
Figure 7C:
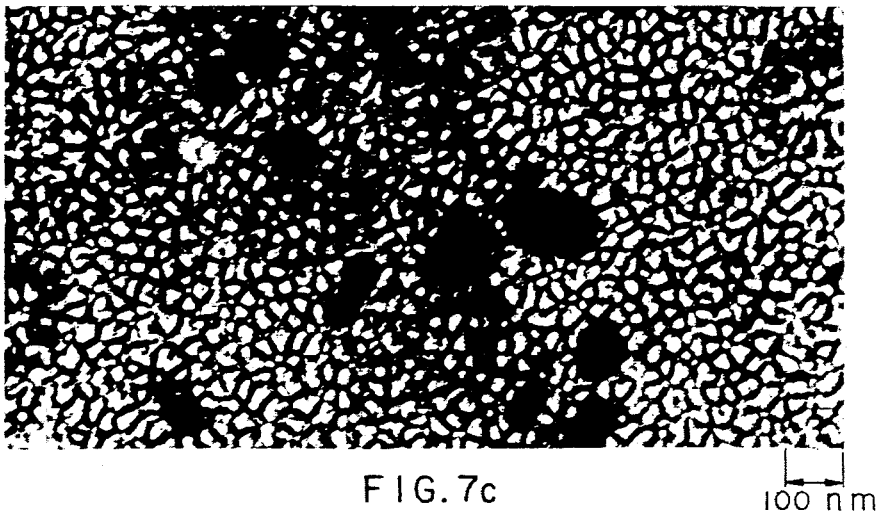
FIG. 7*c* is a transmission electron micrograph of an anodic oxide film formed with phosphorous acid in two minutes.

FIG. 7 shows the aluminum oxide morphology of the 2 minute phosphorous acid anodic film. The film has a well-developed porous cell structure with an average pore diameter of 40 nm. FIG. 7 also shows the aluminum oxide morphology of the 2 minute phosphoric acid anodic film. The cell structure is not well developed. The porous structure evident on the 2 minute phosphorous acid anodic oxide is not evident on the 2 minute phosphoric acid anodic oxide; only incipient porosity is observed after a 2 minute anodization in phosphoric acid. Well developed cell structure with open pores is believed to be critical for good adhesive bonding performance.

FIG. 7 also shows the aluminum oxide morphology of the 20 minute phosphoric acid anodic film. It is seen that this image is similar to the 2 minute film formed in phosphorous acid.

EXAMPLE 8

In this example, specimens were prepared as follows: High purity, 99.99%, aluminum surfaces were vapor degreased by exposure to the vapors of trichloroethylene for 5 minutes at 87° C. Upon cooling, the surfaces were then etched in an acidic bath for 1.5 minutes at 23° C. and then rinsed with flowing tap water for 30 seconds to remove residual etchant. The samples were dried at 50° C. and anodized as follows: One sample was anodized at 20V in 10% (w/w) phosphorous acid solution for 2 minutes at 23° C. One sample was anodized at 10V in 10% (W/W) phosphoric acid solution for 20 minutes at 23° C. Both samples were rinsed for 30 seconds in flowing deionized water, and dried at 50° C. The samples were randomly scribed and immersed in a solution of 10% (v/v) $Br_2$ in absolute methanol until the aluminum metal dissolved. The remaining anodic oxides were rinsed with methanol followed by two rinses with deionized water. The clean anodic oxides were examined with $Al^{27}$ solid state nuclear magnetic resonance (NMR). The results of the NMR analyses are presented in Table 1.

TABLE 1

NMR Analyses of Phosphoric and Phosphorous Anodic Aluminum Oxides

| Electrolyte | Peak Position (ppm) | Peak Assignment | Peak Height (mm) | Ratio Height to Height of Peak at 7 ppm |
|---|---|---|---|---|
| Phosphoric Acid | 61 | Tetrahedral Al—O—Al | 4 | 0.08 |
| | 30 | Tetrahedral Al—O—P | 15 | 0.32 |
| | 7 | Octahedral Al—O—Al | 48 | 1 |
| | −17 | Octahedral Al—O—P | 18 | 0.38 |
| Phosphorous Acid | 65 | Tetrahedral Al—O—Al | 11 | 0.21 |
| | 30 | Tetrahedral Al—O—P | 32 | 0.60 |
| | 7 | Octahedral Al—O—Al | 53 | 1 |
| | −17 | Octahedral Al—O—P | 0 | 0.00 |

The data of Table 1 show that the anodic oxide formed in phosphorous acid is different from that formed in phosphoric acid. The major differences are first that the phosphorous acid anodic aluminum oxide has no octahedral Al-O-P structure (-17 ppm). This structure is evident in the phosphoric acid anodic oxide. Secondly, the phosphorous acid anodic aluminum oxide has more tetrahedral Al-O-P (30 ppm). While not being held to any particular theory, it is possible that the tetrahedral Al-O-P structure enhances adhesive bonding, as the tetrahedral Al is less coordinated than octahedral Al, resulting in higher energy sites for adhesive bonding.

Having thus described the invention, what is claimed is:

1. A laminate suitable for use in vehicular applications, the laminate comprised of:

(a) at least two sheets of an aluminum alloy selected from the group consisting of AA2000, AA6000 and AA7000 series alloys;

(b) said sheets being anodized in an electrolyte containing phosphorous acid ($H_3PO_3$) to provide a 10 nm to 10 μm thick aluminum oxide layer on the sheet surface, the oxide layer having an aluminum coordination number of four predominating for the aluminum-oxygen-phosphorus bond; and (c) an adhesive layer between said sheets, the adhesive being selected from the group consisting of epoxy, acrylic, phenolic, polysulfone and polyimide resins.

2. The laminate in accordance with claim 1 wherein the adhesive layer has reinforcing fibers disposed therein.

3. The laminate in accordance with claim 1 wherein the adhesive layer has a thickness less than the sheets.

4. The laminate in accordance with claim 2 wherein the fibers are continuous aromatic polyamide fibers.

5. The laminate in accordance with claim 1 wherein the alloy is AA7075.

6. The laminate in accordance with claim 1 wherein the alloy is AA7475.

7. The laminate in accordance with claim 1 wherein the alloy is AA2024.

8. A fiber reinforced laminate suitable for use in aircraft applications, the laminate comprised of at least two sheets of AA7075 aluminum alloy, the sheets having a thickness in the range of 0.1 to 1 mm, the sheets anodized in an electrolyte containing phosphorous acid ($H_3PO_3$) to provide a 10 nm to 10 μm thick anodic coating thereon, the oxide layer having an aluminum coordination number of four predominating for the aluminum-oxygen-phosphorous bond, an adhesive and continuous aromatic polyamide reinforcing fiber layer between each pair of adjacent sheets, the fibers disposed in said adhesive, the adhesive bonding said fibers and sheets together to form said reinforced laminate, the adhesive being selected from the group consisting of epoxy, acrylic, phenolic, polysulfone and polyimide resins.

9. A fiber reinforced laminate suitable for use in aircraft applications, the laminate comprised of at least two sheets of AA7475 aluminum alloy, the sheets having a thickness in the range of 0.1 to 1 mm, the sheets anodized in an electrolyte containing phosphorous acid ($H_3PO_3$) to provide a 10 nm to 10 μm thick anodic coating thereon, the oxide layer having an aluminum coordination number of four predominating for the aluminum-oxygen-phosphorous bond, an adhesive and continuous aromatic polyamide reinforcing fiber layer between each pair of adjacent sheets, the fibers disposed in said adhesive, the adhesive bonding said fibers and sheets together to form said reinforced laminate, the adhesive being selected from the group consisting of epoxy, acrylic, phenolic, polysulfone and polyimide resins.

10. A fiber reinforced laminate suitable for use in aircraft applications, the laminate comprised of at least two sheets of AA2024 aluminum alloy, the sheets having a thickness in the range of 0.1 to 1 mm, the sheets anodized in an electrolyte containing phosphorous acid ($H_3PO_3$) to provide a 10 nm to 10 μm thick anodic coating thereon, the oxide layer having an aluminum coordination number of four predominating for the aluminum-oxygen-phosphorous bond, an adhesive and continuous aromatic polyamide reinforcing fiber layer between each pair of adjacent sheets, the fibers disposed in said adhesive, the adhesive bonding said fibers and sheets together to form said reinforced laminate, the adhesive being selected from the group consisting of epoxy, acrylic, phenolic, polysulfone and polyimide resins.

11. The laminate of claim 8 wherein said adhesive comprises an epoxy resin.

12. The laminate of claim 9 wherein said adhesive comprises an epoxy resin.

13. The laminate of claim 10 wherein said adhesive comprises an epoxy resin.

* * * * *